US005140892A

United States Patent [19]

Koine

[11] Patent Number: 5,140,892

[45] Date of Patent: Aug. 25, 1992

[54] AUTOMATIC CANNON FOR MONERGOLE LIQUID PROPELLANTS

[75] Inventor: Richard Koine, Ratingen, Fed. Rep. of Germany

[73] Assignee: Rheinmetall GmbH, Dusseldorf, Fed. Rep. of Germany

[21] Appl. No.: 314,706

[22] Filed: Feb. 24, 1989

[30] Foreign Application Priority Data

Feb. 24, 1988 [DE] Fed. Rep. of Germany ..... 3805621

[51] Int. Cl.[5] ..... F41H 1/04

[52] U.S. Cl. ..... 89/7; 89/13.05

[58] Field of Search ..... 89/7, 13.05, 155, 156, 89/157, 33.03

[56] References Cited

U.S. PATENT DOCUMENTS

| | | | |
|---|---|---|---|
| 2,801,573 | 8/1957 | Herlach et al. | 89/13.05 |
| 2,835,171 | 5/1958 | Lyon | 89/13.05 |
| 3,431,820 | 3/1969 | Chinn et al. | 89/33.03 |
| 3,625,107 | 12/1971 | Smith et al. | 89/33.03 |
| 4,269,107 | 5/1981 | Campbell | 89/7 |
| 4,523,507 | 6/1985 | Magoon | 89/7 |
| 4,693,165 | 9/1987 | Magoon et al. | 89/7 |

*Primary Examiner*—David H. Brown

*Attorney, Agent, or Firm*—Spencer, Frank & Schneider

[57] ABSTRACT

An automatic cannon for a monergole liquid propellant which is designed as a continuously firing drum-type weapon whereby the supply of projectiles, the loading and the dosaging process take place in parallel. The weapon housing of the automatic cannon includes a drum which has a plurality of drum chambers and is disposed in a drum housing so that the drum chambers can be successively rotated into a firing position aligned with the gun barrel. Each drum chamber accommodates a respective projectile chamber and a respective differential piston arrangement for the liquid propellant. The drum is driven in a hybrid manner by a longitudinally displaceable slide, which in turn is driven in one direction by the firing gases supplied through a gas conduction arrangement and in the other direction by a linear electric motor.

18 Claims, 7 Drawing Sheets

AUTOMATIC CANNON FOR MONERGOLE LIQUID PROPELLANTS

BACKGROUND OF THE INVENTION

The present invention relates to an automatic cannon for monergole liquid propellants for firing projectiles from a projectile chamber by means of reaction of the monergole liquid propellant which, during the firing process, is injected in a regenerative manner by a differential piston arrangement into a combustion chamber.

Various machine cannons for liquid propellants have been proposed. They are predominantly designed for the use of diergole liquid propellants, with the liquid propellants frequently being supplied regeneratively into a combustion chamber by means of differential pistons. These prior art automatic cannons are based on a conventional firing and function cycle operating with additive function steps. Consequently, a great problem in the design of such automatic cannons for liquid propellants is that, at the desired high repetition rate, the quantity of liquid propellant required for one round must be made available within a very short time in a dosaging chamber disposed behind the differential piston.

SUMMARY OF THE INVENTION

It is therefore an object of the present invention to provide an automatic cannon for monergole liquid propellants which, employing a differential piston arrangement to regeneratively inject the propellant, permits the parallel occurrence of as many function steps as possible at the desired high repetition rate to thus expand the duration of individual function steps, particularly the dosaging of the liquid propellant.

The above object is generally achieved according to the present invention by an automatic cannon for a monergole liquid propellant for the firing of projectiles from a projectile chamber by means of the reaction of the monergole liquid propellant which is regeneratively injected during firing into a combustion chamber by a differential piston arrangement; wherein: the automatic cannon, in its weapon housing, is provided with a drum which is rotatable about an axis parallel to the bore axis of the gun barrel of the cannon; the drum is provided with a plurality of drum chambers which each include a respective projectile chamber and a respective differential piston arrangement aligned with the respective projectile chamber, and which can be successively aligned with the bore axis of the gun barrel; and a slide, which is disposed in the weapon housing so as to be longitudinally displaceable, is provided to drive the drum.

The particular advantage of the automatic cannon according to the invention is that it is a drum cannon, with the drum including a plurality of projectile chambers and directly associated therewith a respective plurality of differential piston arrangements. In this way, it becomes possible to supply liquid propellant to the chambers during rotation of the drum so that the time available for dosaging within the firing cycle is expanded. Such an expanded time period for dosaging the liquid propellant makes it possible to omit a pump to convey the propellant and instead an inert gas under pressure in the propellant container can be utilized as the propellant conveying drive. In this manner, the prior art, disadvantageous tendency of liquid propellants to develop turbulences when conveyed rapidly by pumps having small conduit cross sections can be prevented. Since, due to the extended time for the propellant dosaging step, the compressive force of the inert gas can be kept low, this results in a reduction of the required conveying output and low flow rates for the liquid propellant so that the required bubble-free conveyance of the propellant is ensured. In addition to these advantages, a further advantage of the automatic cannon according to the present invention is that it permits problem-free, simple installation and improves the operational reliability and service life of the weapon.

Moreover, the automatic cannon according to the invention is advantageous from a safety point of view since it is designed as a quasi continuously firing weapon and with a fire controlled drum drive.

The invention will be described below in greater detail with reference to the drawing figures.

DETAILED DESCRIPTION OF THE PREFERRED EMBODIMENT

Figure 1:
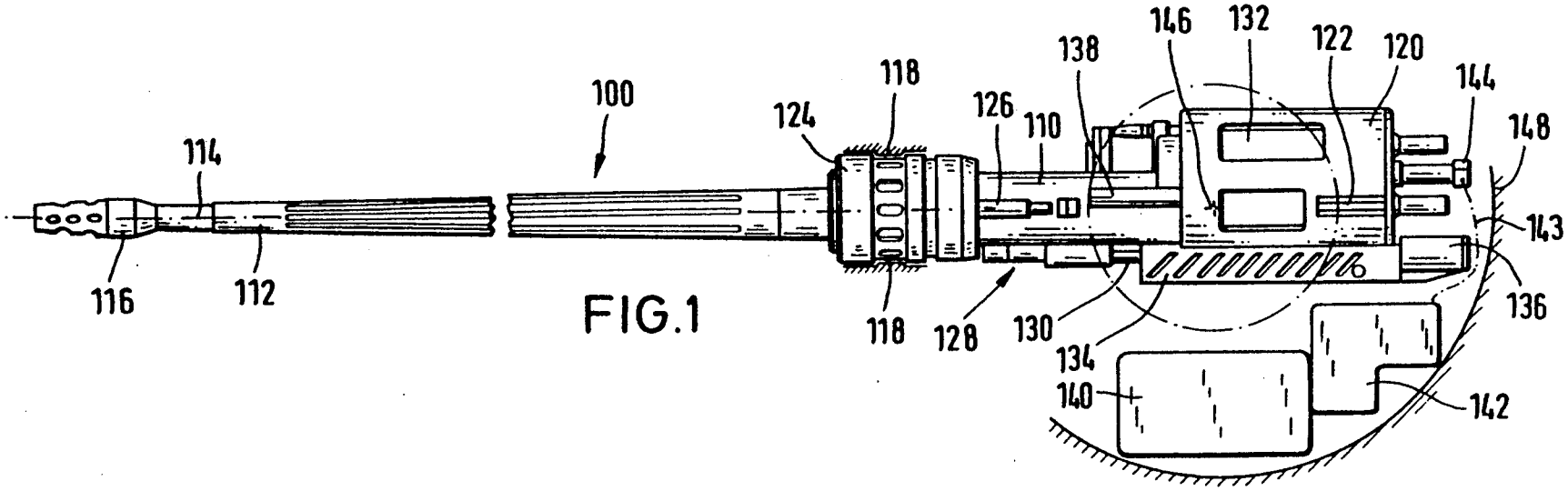
FIG. 1 is a side view of the entire automatic cannon according to the invention.

Referring now to FIG. 1, there is shown an automatic cannon 100 according to the invention including a weapon housing 110 and a gun barrel 112 having a bore axis 114. A muzzle brake 116 is provided on the front or muzzle end of the gun barrel 116. In the course of firing, weapon housing 110 and gun barrel 112 recoil together in a known manner in a weapon cradle 118 which, for reasons of clarity, is indicated only schematically. During this movement, the automatic cannon 100 is positively statically guided by three guides in the cradle 118. For this purpose, respective lateral guide strips 122 are provided on both sides in the rear region of a drum housing 120 in weapon housing 110 so as to engage in corresponding grooves (not shown) of the cradle 118 and form two of these three guides. Also provided is a recoil arrangement 124 which is releasably connected with the weapon housing 110 and is likewise accommodated in the cradle 118. A counter recoil damping device 126 is articulated to the recoil arrangement 124 and is likewise releasably connected with the weapon housing 110. In a frontal region at the bottom of weapon housing 110, a gas conducting arrangement 128 is provided to branch off firing gases from the gun barrel 112 and to drive a slide 130 which, in turn, drives a drum 132 (see FIG. 3) mounted within the drum housing 120.

Below drum housing 120, there is provided a linear electric motor 134 which, together with a separate drive for gas conducting arrangement 128, forms a hybrid drive for drum 132. A buffer 136 is provided on the weapon housing 110 behind the drum housing 120. A work storage element 138, preferably a spring charged work storage element or a hydraulic work storage element, is provided in a frontal or end surface of drum housing 120 oriented toward the gun barrel 112. Below the weapon housing 110 and near the weapon, there is disposed a tank 140 for a monergole liquid propellant and a following connected pump/control block 142 from which the liquid propellant from the tank 140 is pumped via conduits 143 (only schematically indicated here) to a central distributor head 144 at the rear of drum housing 120.

The indicated position of a trunnion axis 146 is particularly advantageous since it minimizes the size of the pivot area at the rear of the weapon identified by a pivot radius 148 if the automatic cannon 100 is pivoted about trunnion axis 146 for elevation.

Figure 2:
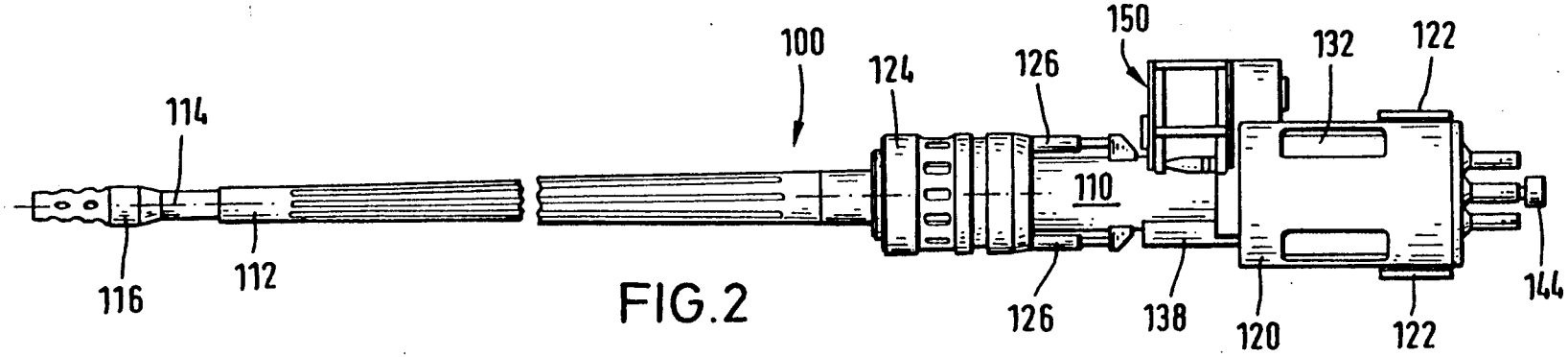
FIG. 2 is a top view of the automatic cannon of FIG. 1.

FIG. 2 is a top view of the entire automatic cannon 100 similar to that of FIG. 1. This FIG. shows particularly clearly the counter recoil damping devices 126 disposed on both sides of the weapon housing 110 and the lateral guide strips 122 attached on both sides of the drum housing 120 to guide weapon housing 110 in its cradle during recoil movement of automatic cannon 100. Additionally, FIG. 2 shows the narrow width of the automatic cannon according to the invention in spite of the projectile feeding arrangement 150 disposed on the side of weapon housing 110 for supplying projectiles to the weapon.

Figure 3:
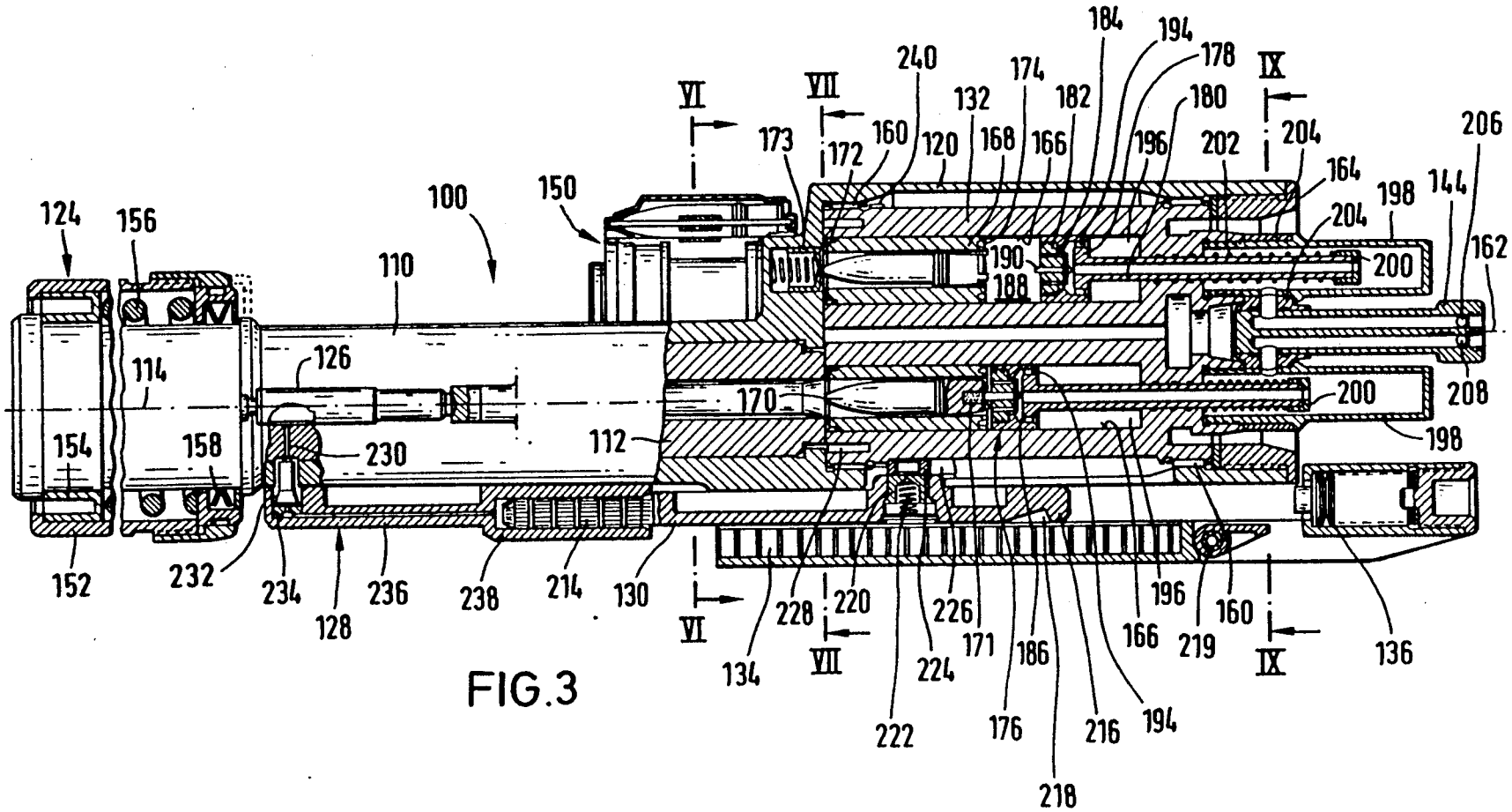
FIG. 3 is an enlarged partial longitudinal sectional view of the automatic cannon of FIG. 1.
Figure 4:
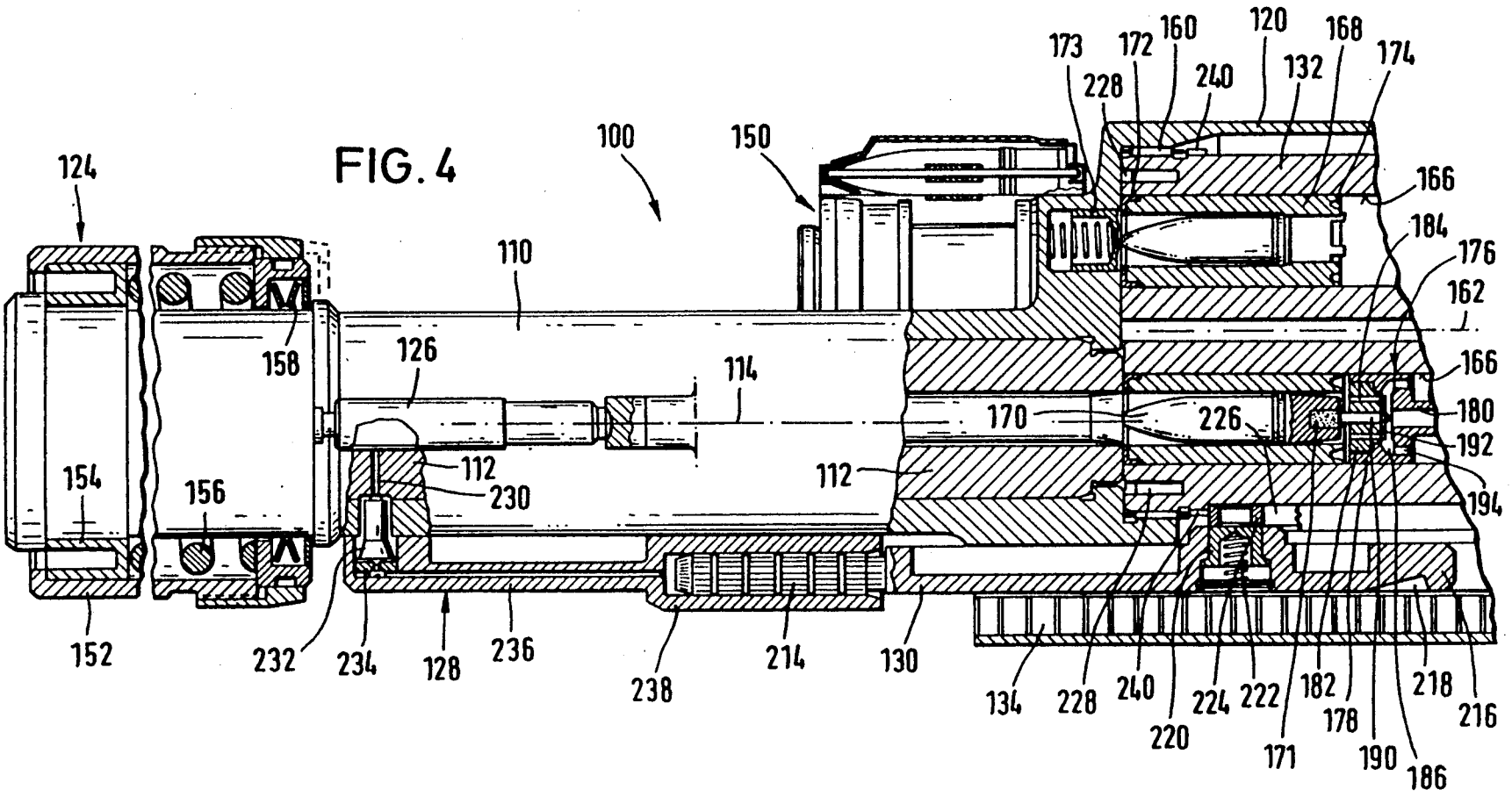
FIG. 4 is a further enlarged partial longitudinal sectional view of only the front portion of the automatic cannon corresponding to the illustration in FIG. 3.
Figure 5:
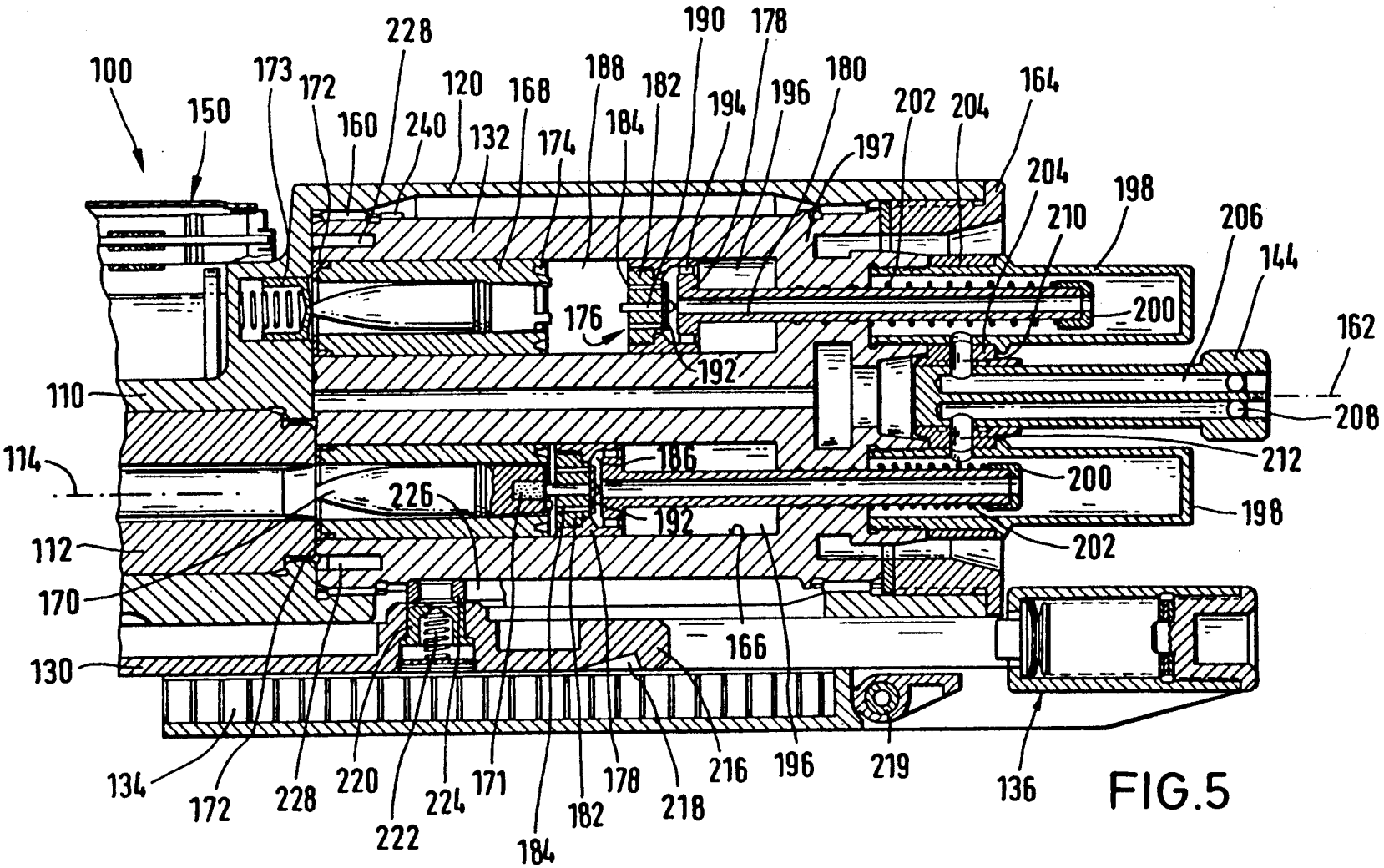
FIG. 5 is a further enlarged longitudinal sectional view of only the rear portion of the automatic cannon corresponding to the illustration in FIG. 3.

FIG. 3 serves to clarify the individual component groups of the automatic cannon 100 and must be viewed in connection with the following FIGS. 4 and 5 which are each partial views of FIG. 3. The individual components of automatic cannon 100 identified in connection with the description of FIGS. 1 and 2, insofar as they are included in FIGS. 3 to 5, have been given the same reference numerals. Moreover, for the sake of simplicity, FIGS. 3 to 5 do not show the front portion of the gun barrel 112 (see FIGS. 1 and 2). The illustration selected for FIGS. 3 to 5 shows a complete firing step but does not correspond to the beginning of a firing cycle.

The recoil arrangement 124 connected with weapon housing 110 together with counter recoil damping devices 126 controls the dynamics of the weapon resulting from firing. In the automatic cannon 100 installed in cradle 118, a recoil housing 152 of recoil arrangement 124 is fixed to the cradle 118 in all degrees of freedom. Thus recoil arrangement 124 constitutes the forward (and third) weapon guide. Recoil housing 152 of recoil arrangement 124 accommodates a guide ring 154 as well as a helical compression spring 156 which serves as a buffer element for movement of the weapon during firing. A pair of cup springs 158 buffers the weapon in its forward end position. All of these springs, i.e., the helical compression spring 156 and the cup springs 158, are concentric with the bore axis 114 of the gun barrel 112.

A rearward portion of weapon housing 110 forms the drum housing 120 in which a drum 132 is mounted in respective forward and rearward roller bearings 160 and 160', which preferably are needle bearings, so as to rotate about an axis of rotation 162 which is disposed parallel to (and, in the illustrated embodiment, above) the bore axis 114. Drum 132 is delimited and supported in the direction of firing i.e., the forward direction, by a frontal face or end surface (not separately numbered) in the interior of drum housing 120, and in the direction opposite to the firing direction, i.e. at the rear, by a screw insert 164 which is screwed into the rear end of the drum housing 120. The drum 132 is provided with a plurality of drum chambers 166, preferably four drum chambers 166, at regular intervals on a pitch circle, whereby the chambers 166 can be sequentially rotated, or indexed, into alignment with the barrel axis 114.

Each drum chamber 166 accommodates a respective sealing sleeve 168 at its front open end, with the sleeve 168 serving as the projectile chamber for one projectile 170 and a detonator charge 171 in the projectile bottom. The front ends of the individual sealing sleeves 168 are gas-tightly sealed with respect to a rear edge of the gun barrel 112 by means of respective sealing rings 172, which preferably have an L-shaped cross section as shown. Each sealing sleeve 168 is provided in its rear end surface with an annular groove 174 so that the gas pressure generated by the reaction products of the liquid propellant urges the sealing sleeve 168 in a controlled manner longitudinally against the rear end of the gun barrel 112 to ensure a proper seal. An arcuate, spring tensioned compensating element 173 acts on a respective sealing sleeve 168 and projectile 170 in certain of the drum chambers (as explained below) in a direction opposite to the firing direction and positions projectile 170 axially in its sleeve-side sealed seat. This is intended, in particular, as a redundant safety measure for the case where, after a round has been fired, readiness to fire is to be maintained for a longer period of time. In this case, the quantity of liquid propellant which might seep through the differential piston 178 into a chamber behind the projectile 170 is limited.

Behind each sealing sleeve 168, a respective differential piston arrangement 176 is provided in each drum chamber 166. Each differential piston arrangement 176 (see also FIGS. 10–12) includes a respective differential piston 178 which is axially aligned and longitudinally movable in a respective drum chamber 166 and is connected with a respective rearwardly extending hollow piston rod 180. The end surface of differential piston 178 facing in the direction of firing is provided with a recess which is filled and sealed by a piston insert 182. This piston insert 182 is provided with overflow channels 184 so that an interior chamber 186 provided in differential piston 178 can be hydraulically connected with a combustion chamber 188 formed in front of differential piston 178 in drum chamber 166. Piston insert 182 of differential piston 178 is additionally provided with a central bore 185 into which is inserted a pin 190 whose rear end, which extends into the interior chamber 186 of differential piston 178, supports a valve disc 192 with which overflow openings or channels 184 in piston insert 182 can be closed. In its rear wall, the differential piston 178 is provided with longitudinal through bores 194 which establish a hydraulic connection between a dosaging chamber 196 formed behind differential piston 178 in drum chamber 166 and the inner chamber 186 provided in the interior of differential piston 178. Each piston rod 180 connected with a differential piston 178 is brought out of a respective drum chamber 166 through an appropriately sealed bore in a rear wall 197 of drum 132 and projects into a respective cylindrical, closed drum chamber terminus 198.

In each drum chamber terminus 198, the end of the respective hollow piston rod 180 is securely connected with an associated open end cap 200 which serves as a rear abutment for a respective helical compression spring 202, which surrounds the piston rod 180 and is supported at its front end against the rear wall 197 of drum 132, so that the piston rod 180 is spring tensioned. In the region of their respectively associated drum chambers 166, all four drum chamber termini 198 are releasably connected with drum 132 and with one another by means of a disc-shaped adapter 204. The axis of symmetry of the adapter 204 is aligned flush with the axis of rotation 162 of drum 132. Adapter 204 is provided with a central recess in which a central distributor head 144 is disposed to supply liquid propellant to the termini 198.

Central distributor head 144 is firmly articulated in weapon housing 110 so that it is unable to participate in the rotary movement of drum 132. Central distributor head 144 is provided with two longitudinal blind bores 206 and 208, with the first blind bore 206 serving as a first propellant dosaging channel and the second blind bore 208 serving as a second channel to conduct a firing pressure pulse and to accommodate backward flowing propellant. Accordingly, each bore or channel 206 and 208 has an associated first transverse bore 210 and a second transverse bore 212 so that a hydraulic connection is established between the drum chamber termini 198 of each drum chamber 166 and the first and second bores or channels 206, 208 by means of adapter 204 (see also FIG. 9).

Drum 132 is driven by a slide 130 which is longitudinally displaceably mounted in weapon housing 110 below drum 132. Rearward movement of slide 130, i.e., in the direction opposite to the direction of firing, is produced by a separate fire controlled drive utilizing the gas pressure of the reaction products of the propellant, while forward movement of slide 130, i.e., in the direction of firing, is generated in part by the stored forces of buffer 136 and in part o completely by setting forces from linear motor 134 underneath slide 130.

For this purpose, the front end of slide 130 is provided with a gas piston 214 and its rear end with a latch 216 equipped with a trigger pocket 218. In the pauses between rounds, slide 130 is blocked from moving forward by the engagement of a trigger lever 219, which is rotatably mounted in weapon housing 110 behind linear electric motor 134, in the trigger pocket 218 of latch 216 of slide 130. To initiate rotational movement of drum 132 due to linear movement of slide 130, a transversely extending control pin 220, having a control or cam roller 224 at its end and charged by a spring 222, is provided on slide 130 such that the control or cam roller 224 engages in a first cam path 226 provided on the circumference of drum 132 in the form of an endless curve. The control kinematic of the first cam path 226, in which control roller 224 of slide 130 is guided, is positively shaped by a second cam path 228 which is provided in the frontal face or end surface of drum 132 facing the gun barrel 112 and in which the work storage element 138 (see in this connection FIGS. 1, 2 and 8) engages. This engagement causes a setting force from work storage element 138 to be impressed on the second cam path 228 which is an endless curve on the frontal face of drum 132.

To initiate the rearward movement of slide 130 by means of a fire controlled separate drive, a transversely extending gas bore 230 is provided in the region of gun barrel 112 in the vicinity of recoil arrangement 124 so as to branch off firing gases from gun barrel 112. The subsequent gas conducting arrangement 128 essentially includes a gas conducting sleeve 232 into which gas bore 230 opens, a gas nozzle 234 provided in gas conducting sleeve 232 to choke the firing gases, and a subsequent gas conduit 236 to conduct the choked firing gases into a piston chamber 238 which receives the gas piston 214 connected with slide 130.

In the region of its end surfaces or frontal faces, the circumference of drum 132 is provided with external teeth 240, preferably with straight teeth, which mesh with corresponding drive gears of projectile supply arrangement 150 (see also FIG. 6) so that the fire controlled rotary movement of drum 132 is utilized to drive projectile supply arrangement 150.

Figure 6:
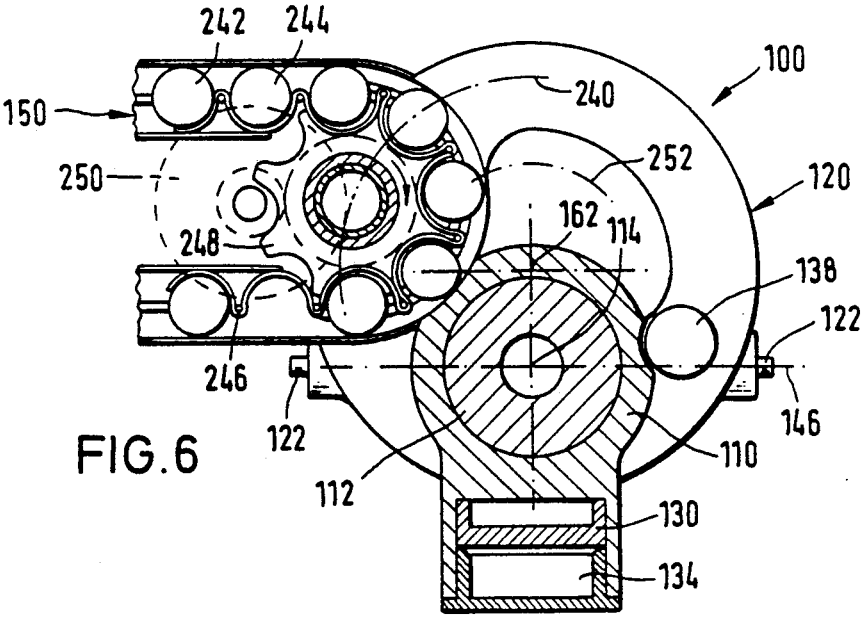
FIG. 6 is a cross sectional view of the automatic cannon of FIG. 3 seen along line VI—VI of FIG. 3.

FIG. 6 is a view of the automatic cannon 100 according to the invention, seen from the side of the muzzle, with the forward portion of weapon housing 110, which encloses gun barrel 112, being shown together with it in a sectional view. In the lower region of weapon housing 110, slide 130 as well as linear electric motor 134 are visible. This figure also clearly shows the configuration of the lateral rear guides 122 on weapon housing 110 which guide weapon housing 110 in its cradle. Moreover, the drawing figure also shows the advantageous arrangement of the trunnion axis 146 of the automatic cannon 100 according to the invention.

Projectile supply arrangement 150 which, in this embodiment, is configured as an alternating projectile supply for a first type of projectile 242 and a second type of projectile 244, is essentially composed of an endless cup-type belt conveyor 246, a star wheel 248 which moves cup-type belt conveyor 246, and a drive gear 250 which drives this star wheel 248 and is in engagement with the external teeth 240 on drum 132.

Figure 7:
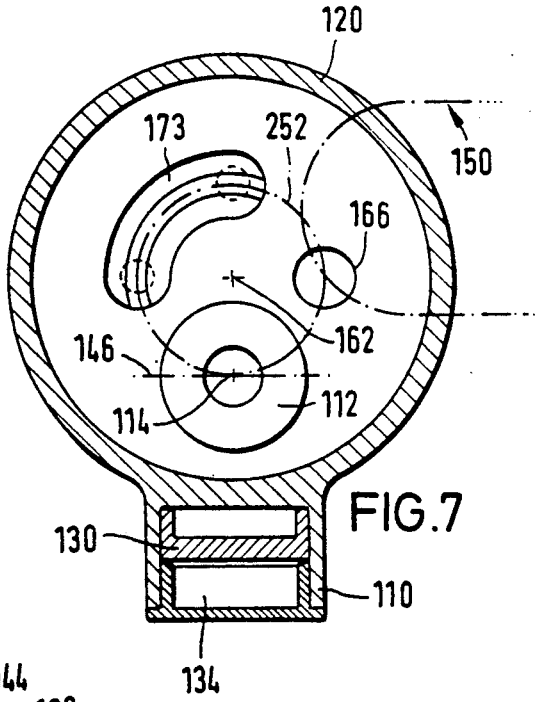
FIG. 7 is a cross sectional view of the automatic cannon of FIG. 3 seen along line VII—VII of FIG. 3.

FIG. 7 is a cross sectional view of the weapon housing 110 of automatic cannon 110 according to the invention in the forward region of drum housing 120 with a view toward the muzzle of gun barrel 112, whose rear edge is visible. A pitch circle 252 of drum 132 passes through the bore axis of gun barrel 112. During rotation of drum 132, the central longitudinal axes of drum chambers 166 lie on the same pitch circle 252 (see in this connection also FIGS. 3 to 5). The arcuate, spring tensioned compensating element 173 (see also FIG. 4) covers, as shown in FIG. 7, approximately one quarter of pitch circle 252 of drum 132. Projectile supply arrangement 150 is indicated schematically to illustrate its position.

Figure 8:
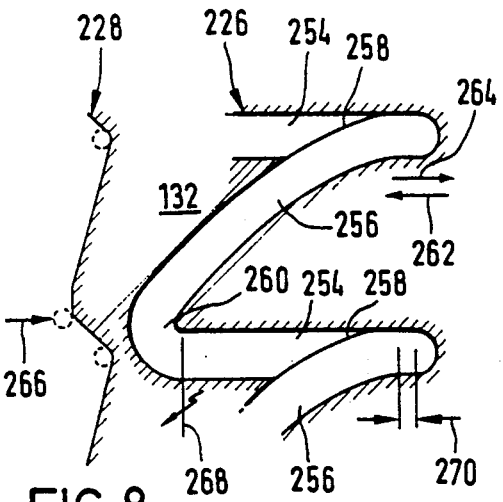
FIG. 8 is a partial view of control curves disposed on a drum of the automatic cannon according to the invention.

FIG. 8 shows the first cam path 226 applied to the circumference of drum 132 in a partial development of this curve and the associated second cam path 228 on the end surface or frontal face of drum 132 facing the gun barrel 112. The first cam path 226, which is an endless groove, has a respective linear section 254 for each projectile chamber. Each linear section 254 changes into a respective curved section 256. In the region of the transition from a linear section 254 to a curved section 256, the curved section 256 is cut deeper into the outer wall of drum 132 so that an edge 258 is formed between the two sections 254 and 256. Under the effect of the firing gases branched off from the gun barrel 112, the cam roller 224 of slide 130 engaged in the first cam path 226 moves slide 30 in the direction of arrow 264 and thus, in the transition region between a linear section 254 and a curved section 256, passes edge 258. For movement in the opposite direction, slide 130 is moved by the setting forces of linear electric motor 134, or by the spring force of buffer 136 or by a combination of these forces, in the direction of an arrow 262, with the edge 258 of cam path 226, which is cut deeper in curved section 256, preventing cam roller 224 of slide 130 from sliding back into linear section 254. The immersion of cam roller 224 (see in this connection also FIG. 5) into the deeper groove of curved section 256 of the first cam path 226 is made possible without problems by the spring 222 which tensions control pin 220 (FIGS. 3-5). In the further course of the curved section 256 of the first cam path 226, cam roller 224 is guided to a transition region 260 from where the first cam path 226 again changes into a linear section 254. In the transition region between the curved section 256 and the "new" linear section 254, the setting force of work storage element 138, indicated by an arrow 266, acts by way of a corresponding edge in the second cam path 228 on the frontal face of drum 132, and thus secures an unequivocal changeover of cam roller 224 from curved section 256 of first cam path 226 to the "new" linear section 254.

To clarify the relationship of cam paths 226 and 228 with the firing cycle in the automatic cannon according to the invention, FIG. 8 also shows the moment of ignition 268 and a possible stroke 270 of buffer 136 (see also FIGS. 3 and 5).

Figure 9:
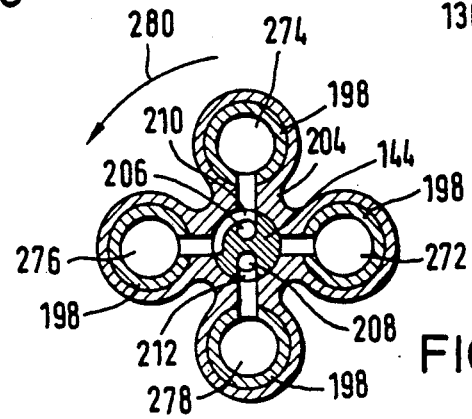
FIG. 9 is a cross sectional view of a drum of the automatic cannon of FIG. 3 seen along line IX—IX of FIG. 3.

FIG. 9 is a sectional view of drum 132 seen in the direction toward the muzzle of gun barrel 112. FIG. 9 serves, in particular, to clarify the positions of the drum chambers 166 during the firing cycle of the automatic cannon according to the invention. The numeral 272 identifies the first position of a drum chamber 166, the numeral 274 identifies a second position, the numeral 276 a third position and 278 a fourth position. In the selected direction of view, the drum rotates counterclockwise in the direction of arrow 280. A firing cycle begins with the rotation of drum 132 which, in the case of the preferably employed four drum chambers 166 shown here, is rotated intermittently by one pitch or segment field of 90°. In the first position 272, a projectile 170 (see also FIGS. 3 to 5) is pushed-bottom end first into the projectile chamber formed in the drum chamber 166 by the sealing sleeve 168. A loading device required to accomplish this is known and is therefore not shown. In the interval between the second position 274 and the third position 276, the respective drum chambers 166 are in communication via transverse bores 210 (see also FIG. 5) in adapter 204 with the first channel 206 so as to measure out the propellant 177. During this interval, the propellant is simultaneously measured out into the drum chambers 166 disposed in the second position 274 and in the third position 276. When a respective drum chamber 166 is in the third position 276, a complete round, including the projectile and its propellant, is available for firing in the drum chamber. During this interval between the second position 274 and the third position 276, the sealing sleeve 168 of the respective drum chamber 166 holding projectile 170 is always charged in the sealing position of sealing sleeve 168 by the arcuate, spring tensioned compensating element 173 (see FIG. 7).

To initiate a shot, drum 132 is rotated by a further pitch segment corresponding to the direction of arrow 280 so that drum chamber 166 containing the complete round previously present in the third position 276 is now transferred to the fourth position 278, where projectile 170 is now aligned with the gun barrel 112. In the fourth position 278, a pressure pulse is conducted to differential piston arrangement 176 by means of the second channel 208 (see also FIG. 5) so that pin 190 in differential piston 178 pierces the detonator charge 171 in the bottom of the projectile 170 and thus initiates the shot.

The operation of the automatic cannon 100 according to the invention will now be described.

A firing cycle is initiated by actuation of trigger lever 219 and linear electric motor 134 is switched on, releasing the partially tensioned spring of buffer 136. The desired type of firing with respect to individual shots, continuous firing, cadence and length of burst can be preselected in a command device which not shown in detail here since it is known and easily combined with the automatic cannon according to the invention.

The activation of linear electric motor 134 and/or the spring force from buffer 136 causes slide 130 to be moved in the forward direction so that control cam roller 224 on control pin 220 of slide 130 is moved over the curved section 256 of the first cam path 226 to thus rotate drum 132 by one drum chamber position. This causes the empty drum chamber 166, which previously had been in the fourth position 278, to be moved to the first position 272 where a projectile 170 of the preselected first projectile type 242 or of the second projectile type 244 is moved from cup-type belt conveyor belt 246 into the sealing sleeve 168 serving as the projectile chamber of the respective drum chamber 16 presently disposed in the first position 272 (see FIG. 10). Due to the rotation of drum 132, the complete round in the third position 276 has been rotated into the fourth position 278, where a pressure pulse is initiated by way of the second channel 208 in central distributor head 144 to advance differential piston 178 in the direction of firing to the extent that the pin 190 in the piston insert 182 is able to pierce the detonator charge 171 disposed at the bottom of projectile 170.

Figure 11:
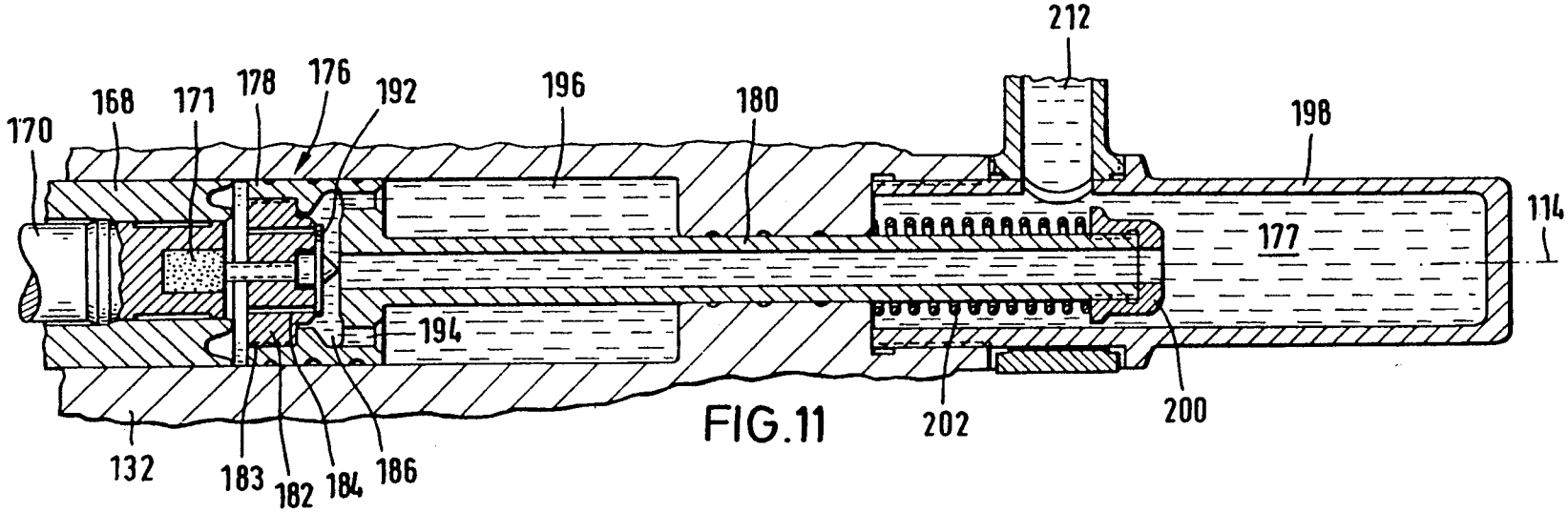
FIG. 11 is an enlarged sectional view of the differential position arrangement shortly before ignition of a detonator charge in the rear of a projectile.
Figure 12:
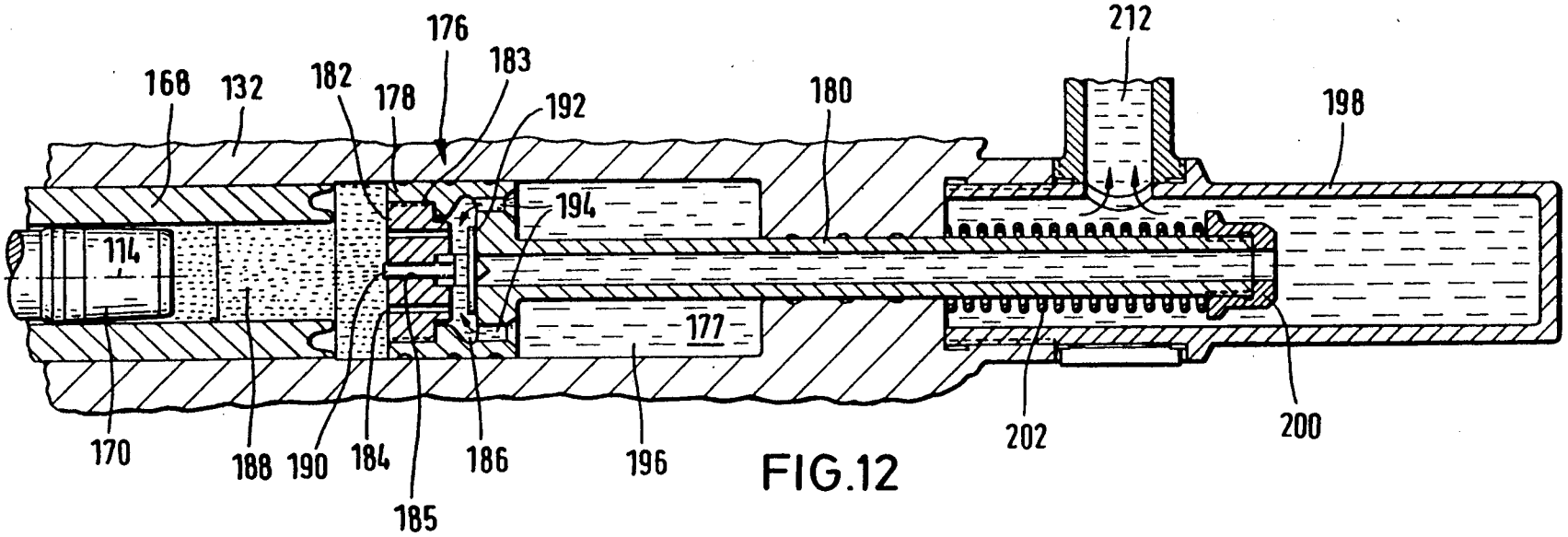
FIG. 12 is an enlarged sectional view of the differential position arrangement during the acceleration phase of the projectile.

The position of the differential piston arrangement 176 at a time shortly before actuation of detonator charge 171 is shown in FIGS. 5 and 11. After actuation of detonator charge 171, the gas pressure now existing between the bottom of the projectile 170 and differential piston 178 from the reaction of detonator charge 171 causes differential piston 178 to move backwards. As shown in FIG. 12, this is connected with the action of pressure on the pin 190 causing it likewise to separately move backward so that valve disc 192 connected with pin 190 releases overflow openings in the piston insert 182. The recoil movement of differential piston 178 pushes the liquid propellant 177 disposed behind differential piston 178 in dosaging chamber 196 of drum chamber 166 through the inlet bores 194 in differential piston 178 into the interior chamber 186 of differential piston 178, and from there the propellant is injected through the now open overflow openings 184 into combustion chamber 188 formed in front of differential piston 178 behind sealing sleeve 168. With increasing injection of liquid propellant into combustion chamber 188, the liquid propellant reacts in the combustion chamber 188 and the resulting gas pressure causes projectile 170 to be accelerated and fired out of the gun barrel 112.

Figure 10:
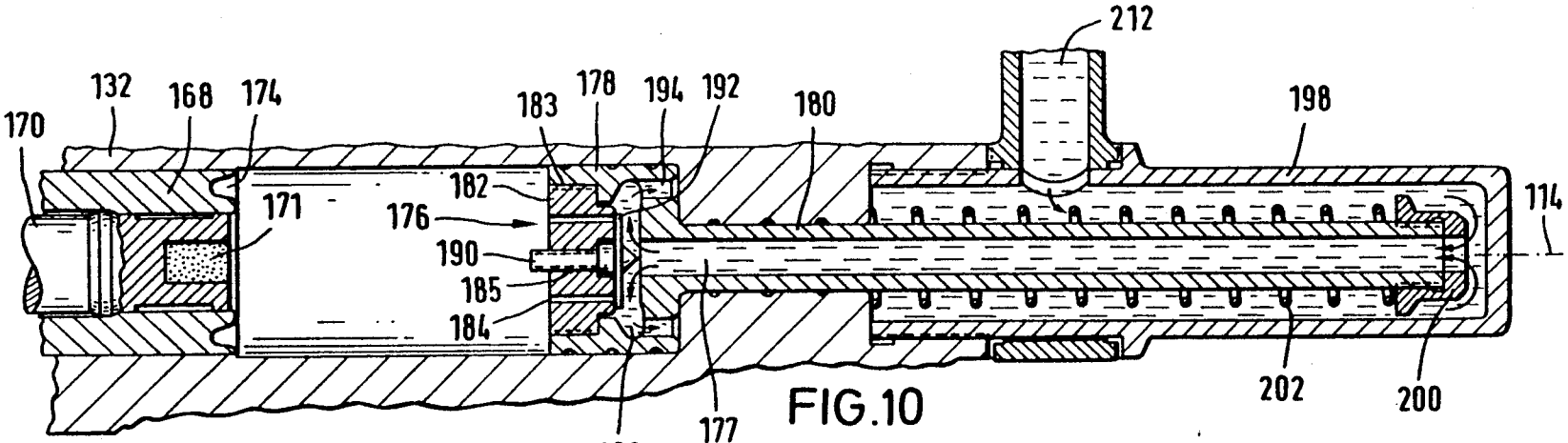
FIG. 10 is an enlarged sectional view of the differential piston arrangement at the beginning of a firing cycle.

During the acceleration phase of projectile 170 (see FIG. 12), the piston 178 continues to move backward as a result of the gas pressure existing in combustion chamber 188 until the liquid propellant in dosaging chamber 196 has been completely expelled from there and has been conveyed to and reacted in the combustion chamber 188. At the end of the acceleration of projectile 170, differential piston 178 lies against the rear end surface of the respective drum chamber 166 as shown in FIG. 10. since the return movement of differential piston 178 causes hollow piston rod 180, which is connected with differential piston 178, to enter into the respective drum chamber germinus 198, part of the liquid propellant previously disposed in drum chamber terminus 198 is displaced and flows through the second channel 208 in central distributor head 144 and from there through conduits (not shown) back into the tank 140 near the weapon. The recoil movement of differential piston 178 during the regenerative injection of the liquid propellant during firing is supported by the compression spring 202 which surrounds piston rod 180 in the terminus 198. Valve disc 1982, which is connected with pin 190 and which releases overflow openings 184 in piston insert 182 during the regenerative injection of the liquid propellant, has such a diameter that it is unable to close the inlet bores 194 provided in differential piston 178. On the other hand, during the regenerative injection of liquid propellant into the combustion chamber 188, the gas pressure on pin 190 causes valve disc 192 to seal hollow piston rod 180 when a shot is being fired.

Once projectile 170 has passed the transverse gas bore 230, which is a part of gas conducting arrangement 128 and is disposed in the gun barrel 112, pat of the firing gases escape through gas bore 230 into gas slide sleeve 232 and, if the gas pressure is high enough, force through gas nozzle 234 into piston chamber 238 with the necessary gas pressure. Consequently, gas piston 214, which is connected with slide 130, is charged with pressure so that slide 130 is moved rearwardly, opposite to the direction of firing, and control cam roller 224 on control pin 220 of slide 130 moves along the linear section 254 of the fist cam path 226 without causing drum 132 to move. If it si desired to cease firing for a while, after contact of the latch 216 connected with slide 130 on the buffer 136, the trigger packet 218 of latch 216 is caused to be caught by the trigger lever 219, thus arresting the movement of the slide 130. Otherwise, the spring forces of buffer 136 cause slide 130 to be moved forward again so that the engagement of control cam 224 of slide 130 in the curved section 256 of the first cam path 226 causes drum 132 to be rotated aging. Thus a drum chamber 166 containing a complete round again moves from the third position 276 into the fourth position 278 so that a new round can be fired.

During this time, the other drum chambers 166 pass through the first position 272 in which the sealing sleeve 168 of the respective drum chamber 166 in this position is loaded with a projectile 170 and then, upon renewed rotation of drum 132, into the second position 274 and on to the third position 276. The dosaging process for the monergole liquid propellant begins in the second position 274, with the propellant being pressed from tank 140 near the weapon through pump/control block 142 and respective conduits 143 into the first channel 206 of central distributor head 144. From there, the propellant travels through the first transverse bore 210 in adapter 204, which bore is in communication with the first channel 206, into the drum chamber terminus 198 of that drum chamber 166 which is disposed in the second position 274 and/or in the third position 276. The propellant pressed into the respective drum chamber termini 198 flows via the cup 200 and the hollow piston rod 180 of the respective differential piston arrangement 176 into the interior chamber 186 of the respective differential piston 178. The monergole propellant flowing in through hollow piston rod 180 acts on valve disc 192 so that it closes overflow openings 184 in the piston insert 182 of the respective differential piston arrangement 176, permitting the propellant to flow from the interior chamber 186 of the respective differential piston 178 through inlet bores 194 in the differential piston 178 and along the rear wall of drum chamber 166. This causes the dosaging chamber 196 to be formed behind the differential piston 178. With increasing fill level of dosaging chamber 196 in the respective drum chamber 166 under consideration during the interval in which it moves from the second position 274 to the third position 276, the differential piston arrangement 176, and particularly the differential piston 178, is moved toward the sealing sleeve 168 in the front region of drum chamber 166. The dosaging process, i.e. filling dosaging chamber 196 with liquid propellant, is completed before pin 190 in the central recess of piston insert 182 reaches the bottom of the projectile 170 disposed in sealing sleeve 168. Only when drum 132 is rotated further, which causes the drum chamber 166 which was loaded with a complete round in the third position 276, to be moved into the fourth position 278, will an additional pressure pulse on differential piston 178 cause differential piston 178 to move forward to such an extent that pin 190 is able to actuate the detonator charge 171 disposed in the bottom of projectile 170.

The invention now being fully described, it will be apparent to one of ordinary skill in the art that many changes and modifications can be made thereto without departing from the spirit or scope of the invention as set forth herein.

What is claimed is:

1. In an automatic cannon using a monergole liquid propellant for the firing of projectiles from a projectile chamber by means of the reaction of the monergole liquid propellant, said cannon including a gun barrel, a weapon housing attached to the rear end of said gun barrel, a projectile chamber for a projectile to be fired disposed in said weapon housing, and a differential piston arrangement means, disposed in said weapon housing, for regeneratively injecting monergole liquid propellant, during firing of a projectile, from a dosaging chamber into a combustion chamber formed behind said projectile chamber; the improvement comprising:

a drum disposed in said weapon housing and having a plurality of longitudinally extending drum chambers which are disposed on a common pitch circle of said drum, which are each open in the direction facing said gun barrel, and which each includes a respective said projectile chamber at its said open end and a respective said differential piston arrangement means aligned with the respective said projectile chamber;

means for mounting said drum within said housig for rotation about a longitudinal axis parallel to the bore axis of said gun barrel so that said drum chambers can be successively aligned with said gun barrel;

and a means, including a longitudinally displaceable slide disposed in said weapon housing, or driving said drum.

2. An automatic canon as defined in claim 1, wherein said drum includes four of said drum chambers which are symmetrically disposed.

3. An automatic cannon as defend in claim 1, further comprising: means for supplying a projectile to a respective projectile chamber of one of said drum chambers when said one of said drum chambers is in a first position which is not aligned with said bore axis of said gun barrel; and means for supplying liquid propellant to the respective said differential piston arrangement means for said one of said drum chambers when it is in a position disposed between said first position and a position wherein it is aligned with said bore axis of said bun barrel.

4. An automatic cannon as defined in claim 1, wherein:

a respective sealing sleeve is provided in each said drum chamber to serve as said projectile chamber and the end of said sealing sleeve facing said open end of each respective said drum chamber is provided with a respective sealing ring to seal said sleeve against the rear of said gun barrel when the respective said drum chamber is aligned therewith.

5. An automatic cannon as defined in claim 4, further comprising means, responsive to the firing gases produced during firing of a projectile, for causing said sealing ring to be pressed against the said rear end of said gun barrel.

6. An automatic cannon as defined in claim 4, wherein said rum includes four of said from chambers which are symmetrically disposed.

7. An automatic cannon as defined in claim 1, wherein: said slide is provided with a transversely extending spring tensioned control pin having a control cam at its end; and said control cam engages in an endless cam path which is disposed on the circumference of said drum and which is arranged so that a longitudinal movement of said slide in said weapon housing can cause said drum to undergo a rotational movement.

8. An automatic cannon as defined in claim 7, wherein said means for firing said drum further includes a linear electric motor disposed in said weapon housing below said slide for longitudinally displacing said slide.

9. An automatic cannon as defined in claim 7 wherein said cam path is arranged such that only a longitudinal movement of said slide in a direction toward the front of said weapon causes a rotational movement of said drum.

10. An automatic cannon as defined in claim 9, wherein said means for driving said drum further includes a gas piston connected to the front end of said slide, and a gas conduction means, responsive to firing gas burned off from said gun barrel, for charging said gas piston to drive said slide in a rearward direction.

11. An automatic cannon as defined in claim 10, wherein said means for driving said drum further includes a linear electric motor disposed in said weapon housing below said slide for longitudinally displacing said slide in the forward direction.

12. An automatic canon as defined in claim 1 wherein each said differential piston arrangement means includes: a piston which is axially movably guided in a respective said drum chamber and which divides said drum into a combustion chamber ahead of the piston and a dosaging chamber behind the piston, said piston having a central cylindrical recess formed in a front end surface of said piston and having a rear end wall which is connected with a piston rod having an axial, throughgoing opening which extends through said rear end wall and opens into said recess;

a cylindrical insert which is disposed in said recess, is fastened to said piston, adjacent said front end surface, and extends from said front end surface partially into said recess, whereby an intermediate chamber is formed in the interior of said piston;

a first plurality of concentrically arranged, axially parallel overflow bores extending through said inert;

a second plurality of concentrically arranged axially parallel inlet bores extending through said rear end wall of said piston;

a valve means mounted on said insert for closing said plurality of overflow bores when in a first position and for closing said axial opening in said piston rod when in a second position; and means, connected to said valve means, for causing ignition of liquid propellant disposed in said combustion chamber of the associated said drum chamber.

13. An automatic cannon as defined in claim 12, wherein said insert is screwed into said piston in a liquid and gas tight manner.

14. An automatic cannon as defined in claim 12, wherein the front end surface of said insert is flush with said front end surface of said piston.

15. An automatic cannon as defined in claim 12, wherein: said insert is provided with an axial through bore; and said valve mans includes a disc-shaped valve plate disposed in said indeterminate chamber and fastened to a rear end of a pin-shaped valve stem disposed in said axial bore of said insert for movement along the longitudinal axis, and with the diameter of said valve plate being sufficiently large so as to cover and close said first plurality of overflow bores when said valve plate is in said first position but not sufficiently large as to cover said second plurality of inlet bores when said valve plate is in said second position.

16. An automatic cannon as defined in claim 15, wherein said means for causing ignition comprises a font end surface of said valve stem which, in a manner similar to a firing pin, initiates an ignition charge disposed at the base of a projectile disposed in the respective said projectile chamber upon forward movement of said piston.

17. An automatic canon as defined in claim 2, wherein: a rear wall of said drum chamber is provided with a coaxial bore through which the rear end of said piston rod of said differential piston guidingly extends; and said rear end of said piston rod is disposed in a closed hollow cylinder which serves as a reservoir of the liquid propellant to be supplied to respective said drum chamber via said position rod, and which is provided with a plurality of openings which are connected to a distributing mans for distributing liquid propellant to the respective said differential piston arrangement means.

18. An automatic cannon as defined in claim 17, wherein: a centrally open cap is connected to the open rear end surface of said piston rod; and, a coil spring is disposed around said piston rod and between said end cap and said rear wall of said drum chamber, whereby the piston is pretensioned by the spring force.

* * * * *